United States Patent [19]

Conboy

[11] 3,933,388

[45] Jan. 20, 1976

[54] INTERLOCK CONTROL SYSTEM FOR A FLUID-OPERATED HOIST

[75] Inventor: Stewart J. Conboy, St. Clair Shores, Mich.

[73] Assignee: D. W. Zimmerman Mfg. Inc., Madison Heights, Mich.

[22] Filed: July 17, 1974

[21] Appl. No.: 489,391

[52] U.S. Cl. ..... 294/64 R; 254/168; 214/650 SG

[51] Int. Cl.[2] ..... B66C 1/02

[58] Field of Search ..... 254/168, 173 R, 186 R, 254/150 R; 294/64 R, 65; 214/658, 650 SG, 1 BB, 1 BS, 1 BT, 1 BV, 1 BH

[56] References Cited

UNITED STATES PATENTS

| | | | |
|---|---|---|---|
| 2,942,745 | 6/1960 | Horton | 294/64 R |
| 3,187,989 | 6/1965 | Barto | 294/64 R |
| 3,253,719 | 5/1966 | Povlacs et al. | 294/64 R |
| 3,756,563 | 9/1973 | Stone | 254/168 |

*Primary Examiner*—Frank E. Werner
*Assistant Examiner*—Kenneth Noland
*Attorney, Agent, or Firm*—Allen D. Gutchess, Jr.

[57] ABSTRACT

Fluid-operated, load-handling apparatus is provided with an interlock control system. The fluid-operated apparatus specifically is a pneumatically-operated hoist having a two-handle operator control, one for raising a load and one for lowering the load. The interlock system enables normal operation of the hoist when a load is properly engaged by a load-engaging unit of the hoist and also when no load at all is present. However, the system prevents operation of the hoist if a load is present and not properly engaged. The interlock system includes a load-sensing device and a load-sensitive valve operated by the device, and further includes a pressure-sensitive valve. The hoist can be operated normally when neither valve is actuated or both are actuated, but not when one is actuated.

9 Claims, 4 Drawing Figures

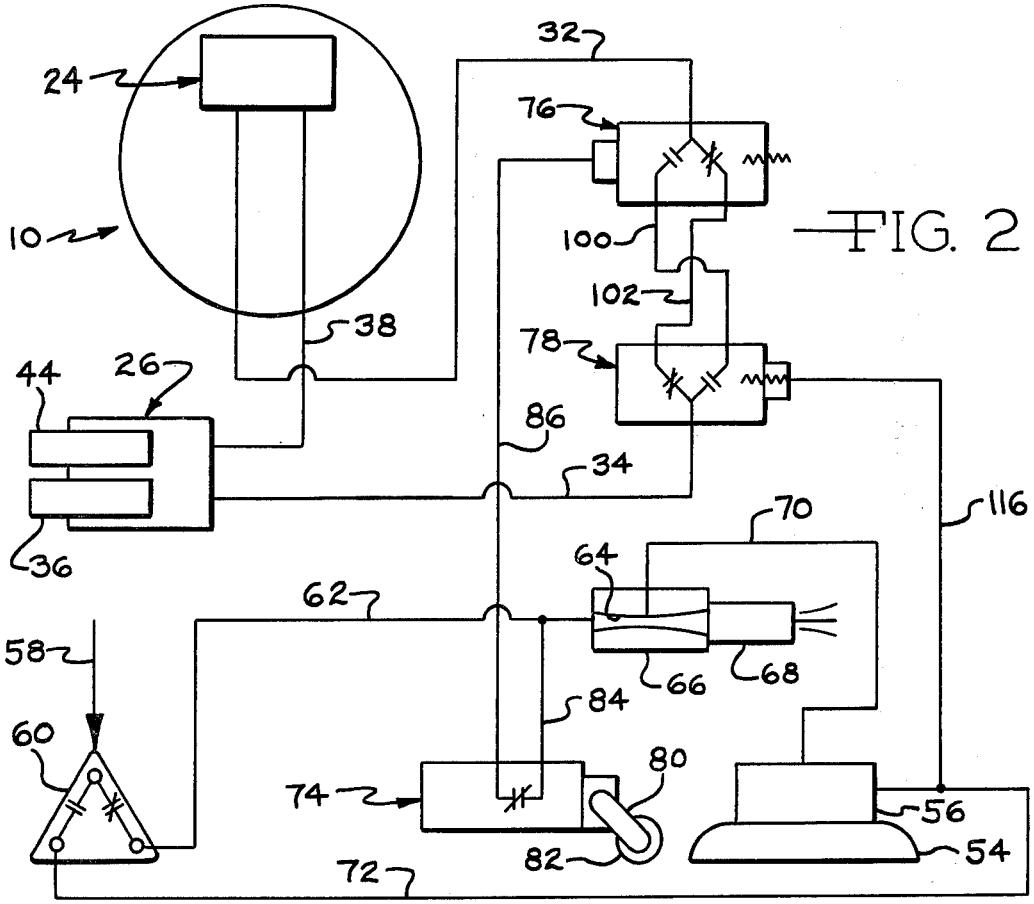
FIG. 2
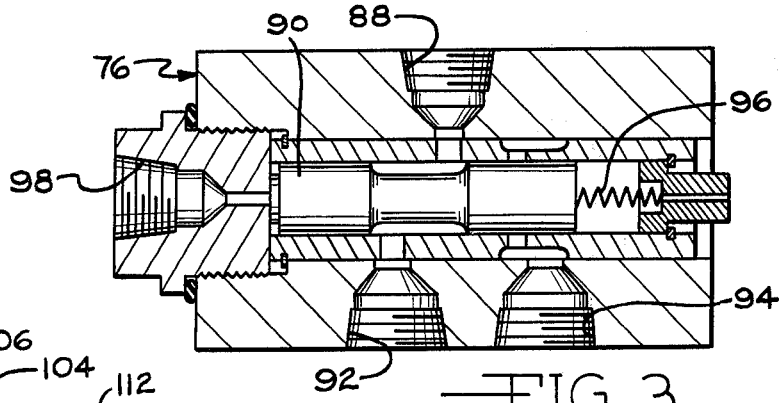
FIG. 3
FIG. 4
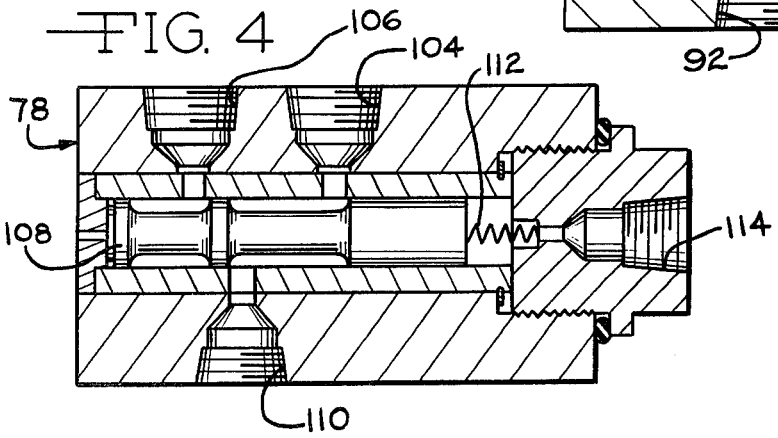

INTERLOCK CONTROL SYSTEM FOR A FLUID-OPERATED HOIST

This invention relates to a fluid-operated hoist with an interlock system.

Fluid operated hoists as shown in U.S. Pat. No. 3,325,148 are now in wide-spread use for manipulating loads. Hoists of this type have an operator control for either raising a load or lowering it. Such hoists are frequently used with fluid-operated, load-engaging units which are operated by fluid-pressure to engage and disengage the loads. U.S. Pat. No. 3,423,119 discloses examples of such units employing vacuum.

Heretofore, it has been possible with such fluid-operated hoists for an operator to raise a load when the load-engaging unit has not been fully engaged therewith. Under these conditions, the load can be dropped from a height above the floor or other support and can injure the operator or others, or damage the load or whatever it drops upon. If the operator does not quickly release the control when this occurs, the load-engaging unit can quickly rise or fly up, with no load being present, and cause injury to the operator or others or damage the unit itself or an object, if struck.

Mechanical means have been employed to a limited extent in the past to prevent the load-engaging unit from quickly rising or flying up if the load is released. Means of this nature are disclosed in U.S. Pat. No. 3,276,747. Such mechanical means physically stops the cable drum of the hoist when its speed of rotation is excessive. At the same time, the hoist hook is completely stopped and the operator loses control over it. Also, the operator often may have to manipulate the load more slowly than he otherwise would in order to prevent premature operation of the mechanical means. While this arrangement can prevent injury from the hook flying up, there is no known means available for this type of hoist for preventing injury or damage if the load is dropped.

The present invention provides a fluid-operated, load-handling hoist including a safety interlock system which prevents a load being handled from being lifted by the hoist when the load is not fully engaged by a load-engaging unit of the hoist. The interlock system includes a load-sensing device which is effective to operate a load-sensitive valve when a load is present adjacent the load-engaging unit. The system further includes a pressure-sensitive valve which is actuated when the load-engaging unit engages the laod under proper pressure to provide full engagement. If both of the valves are actuated, the hoist can be operated normally; this is also true if neither of the valves is actuated. If, however, a load is present by the load-engaging unit and is not properly engaged thereby, then only one of the valves will be operated and the hoist operation will be blocked. With a vacuum cup in the unit, a vacuum of a sufficient value must be attained before the pressure-sensitive valve will be actuated. If a positive-pressure clamp is employed in the load-engaging unit, then pressure behind the clamp must be of a sufficient value before the pressure-sensitive valve will be actuated.

It is, therefore, a principal object of the invention to provide a fluid-operated, load-handling hoist with an interlock system to prevent injury and to prevent damage.

Another object of the invention is to provide a fluid-operated hoist with an interlock system which prevents operation of the hoist in the event that a load-engaging unit thereof fails to properly engage a load.

A further object of the invention is to provide a fluid-operated hoist with an interlock system which enables normal operation of the hoist if no load is present or if a load is present and properly engaged, but prevents operation of the hoist if a load is present and not properly engaged.

Yet another object of the invention is to provide a fluid-operated hoist with an interlock system including a load-sensitive valve and a pressure-sensitive valve, either of which alone can prevent operation of the hoist.

Many other objects and advantages of the invention will be apparent from the following detailed description of preferred embodiments thereof, reference being made to the accompanying drawings, in which:

FIG. 2 is a diagrammatic view of fluid controls of the apparatus of FIG. 1;

FIG. 3 is an enlarged, schematic view in longitudinal cross section of a load-sensitive valve of the interlock system; and FIG. 4 is an enlarged, schematic view in longitudinal cross section of a pressure-sensitive valve of the interlock system.

Figure 1:
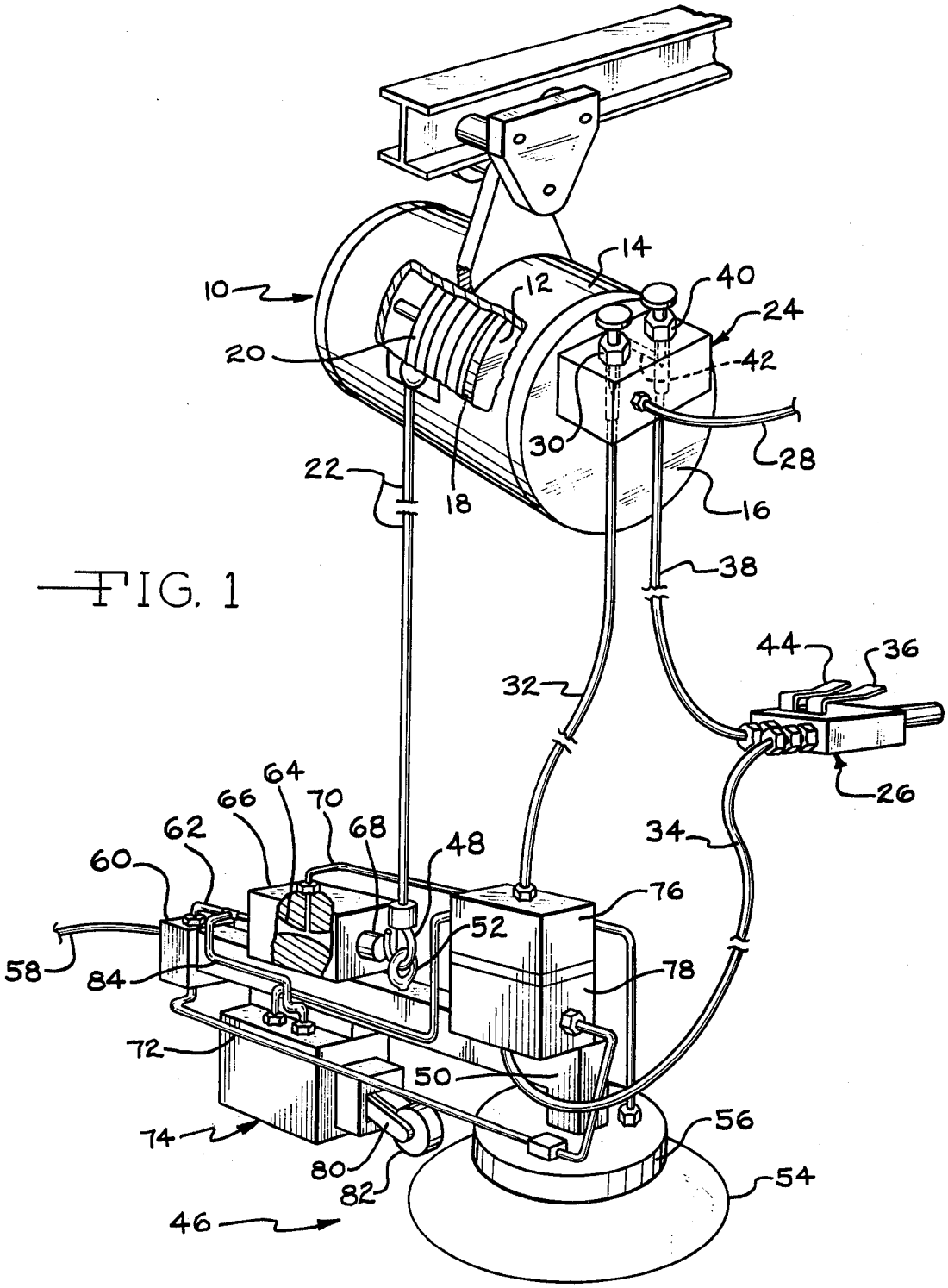
FIG. 1 is a schematic overall view in perspective, with parts broken away and with parts in section, of a fluid-operated hoist, a fluid-operated, load-engaging unit, and an interlock system according to the invention.

Referring particularly to FIG. 1, a fluid-operated hoist is indicated at 10 and preferably is of the type shown in U.S. Pat. No. 3,325,148, although other fluid-operated hoists can also be used advantageously with the invention. The hoist 10 basically includes a chamber 12 to which fluid, usually air, is supplied under pressure. The chamber 12 is formed by a hoist housing 14 and an end cover 16, along with a movable piston 18 forming the other end of the chamber. A cable drum 20 is located adjacent the piston 18 and carries a flexible cable or elongate flexible member 22. When fluid under sufficient pressure is supplied to the chamber 12, it forces the piston 18 toward the left, as shown in FIG. 1, and moves the cable drum 20 in the same direction. The drum 20 is supported on a ball-screw assembly (not shown) which causes the drum to rotate as it moves longitudinally therealong in the housing 14. When the piston moves toward the left, the drum 20 rotates in a manner to raise the cable 22 and any load carried thereby. When the pressure in the chamber 12 is sufficiently low, the weight of the load carried on the cable will cause the drum to rotate in the opposite manner to lower the cable and to cause the piston 18 to move toward the right on the ball-screw assembly, reducing the volume of the chamber 12. Hence, when the pressure in the chamber 12 is sufficiently high, it will raise the cable 22 and the load; when the pressure is sufficiently low, the load and the cable will move lower.

The pressure in the chamber 12 is controlled through a manifold member or block 24 and a remotely-located hand controller 26 which is spaced from the hoist and can be controlled by an operator standing on the floor therebelow near a load to be manipulated. Fluid such as air is supplied from a suitable source through a line 28 to the manifold block 24 where the flow can be contolled by a needle valve 30. This air can then pass through flexible lines or hoses 32 and 34 to the controller 26. When an up handle 36 of the controller 26 is manipulated or depressed, the air can then flow through a flexible line or hose 38 to the manifold block 24 and past a second needle valve 40 into the chamber 12 through an inlet passage 42. The pressure in the chamber 12 can then be increased as long as the up lever 36 is depressed, with this pressure increasing up to the supply pressure of the air in the supply line 28, if the lever is depressed long enough. Also, air pressure in the hoist chamber 12 can be decreased by manipulation or depression of a down handle or lever 44 of the controller 26 whereby the chamber 12 can then be vented through the passage 42, the line 38, and a vent (not shown) in the controller 26. The rate of the air pressure increase or decrease also can be controlled by the extent the lever 36 or 44 is depressed, as is more fully described in the aforesaid U.S. Pat. No. 3,325,148.

A fluid-operated, load-engaging unit 46 is connected through a hook 48 to the cable 22. The unit 46 can be of a type disclosed more fully in U.S. Pat. No. 3,423,119. The unit 46 basically includes a frame 50 having a ring 52 connected to the hook 48. A fluid-operated, load-engaging vacuum cup 54 is mounted on a central hub or supporting block 56 which, in turn, is fastened to the frame 50. Vacuum is established in the cup 54 to enable it to securely engage a load and means are also provided to supply air under pressure to the vacuum cup to blow off the cup and enable the unit to quickly disengage a load.

Air from a suitable source, which can be the same as that for the line 28, is supplied through a line 58 to a three-position valve 60 (FIGS. 1 and 2). In one position of this valve, air is supplied through a line 62 to a venturi passage 64 in a block 66, with this air being dissipated through an exhaust silencer 68. A vacuum line 70 communicates with the throat of the venturi passage 64 so that a vacuum is established in the line 70 when air is supplied through the venturi passage 64, in a manner well-known in the art. The vacuum line 70 is connected with the vacuum cup 54 through the hub 56 to establish a vacuum therein. A check valve can be located in the line 70 or the hub 56 to prevent the vacuum established in the cup 54 from being lost in the event of failure of the air supplied to the venturi.

In another position of the valve 60, air is supplied through a line 72 to the hub 56 and the vacuum cup 54 to supply air under pressure thereto and quickly destroy the vacuum therein. This enables the vacuum cup 54 to be disengaged quickly from the load and thereby enable faster manipulation of the load by the operator.

It will be appreciated that when the operator engages the vacuum cup 54 with the load, he might depress the up lever 56 of the controller 26 to begin to raise the load before the vacuum is fully established between the load and the cup. A proper vacuum may also not be attained because the surface of the load is too rough or uneven or because the vacuum cup is damaged or defective, by way of example. In such instances, the load might be raised several feet and then be dropped because of the partial vacuum. The load can injure the operator or others as well as cause damage to the load itself or whatever it is dropped upon. At the same time, if the load is dropped with the operator having the lever 36 depressed, the load-engaging unit 46 and the cable 22 will quickly rise or fly up since the pressure in the chamber 12 of the hoist 10 is at a substantial value and there is no load on the unit 46. This can result in damage to the operator or anyone else in the way of the flying unit as well as damage to the unit itself, the hoist, or other objects.

To prevent such an occurrence, the invention provides a safety interlock system which prevents operation of the hoist if a proper pressure, negative in this instance, has not been established in the load-engaging unit and yet the hoist can be operated normally if the load is properly engaged or no load is present at all. The interlock system basically includes three components: a load-sensing device 74, a load-sensitive valve 76, and a pressure-sensitive valve 78. The load-sensitive valve 76 and the pressure-sensitive valve 78 are in series with the controller 26, between the hoist chamber 12 and the fluid supply 28.

The load-sensing device 74 is supported below the frame 50 and has a lever arm 80 with a roller 82 positioned near the vacuum cup 54 so as to be engaged and raised in a counterclockwise direction by a load engaged by the vacuum cup 54. The device 74 has an internal valve which is in a normally closed position and which is opened when the lever arm 80 is raised. Air is supplied to the device 74 through a branch line 84 communicating with the air line 62 for the venturi passage 64. The devices 74 also has an outlet line 86 which communicates with the load-sensitive valve 76.

The load-sensitive valve 76, also shown in FIG. 3, has an inlet 88 which receives the flexible line 32 and contains a spool 90 which enables the inlet 88 to communicate with an outlet 92, as shown, or an outlet 94, when the spool 90 is shifted toward the right. The spool 90 is normally in the lefthand position, as shown, being urged to that position by a spring 96. When air uder sufficient pressure is supplied through an inlet 98, the spool moves to the right. In the latter position, the inlet 88 communicates with the outlet 94 and is blocked from the outlet 92. The outlet 92 communicates with the pressure-sensitive valve 78 through a line 100 and the outlet 94 communicates with the pressure-sensitive valve 78 through a line 102.

The pressure-sensitive valve 78 is also shown in FIG. 4. It has an inlet 104 communicating with the line 100 and an inlet 106 communicating with the line 102. The valve 78 has a spool 108 which enables the inlet 104 to communicate with an outlet 110 when the spool is in the position shown, toward the left end of the valve, and the inlet 106 communicates with the outlet 110 when the spool is positioned towards the right end of the valve. The spool is urged toward the left end by a spring 112 and is moved to the right end when vacuum of a sufficient value is established at the right end through an inlet 114. The outlet 110 connects with the flexible line 34 and the inlet 114 communicates with the hub 56 and the vacuum cup 54 through a line 116.

The operation of the interlock system will now be described. Assuming there is no load carried by the vacuum cup 54, it is desired that the load-engaging unit 46 be able to be raised and lowered by normal operation of the hoist 10. Accordingly, the valve of the load-sensing device 74 is closed and the spool 90 of the valve 76 is in the left hand position under the influence of the spring 96 so that the inlet 88 communicates with the outlet 92 and the line 32 communicates with the line 100. With no load, there can be no vacuum in the cup 54 so that the spool 108 of the valve 78 is in the left hand position under the influence of the spring 112, with the inlet 104 communicating with the outlet 110. The line 100 thereby communicates with the line 34 so that the line 32 communicates with the line 34 and the air supply 28 is in communication with the controller 26. Hence, the controller 26 can be used to supply air to the hoist chamber 12 in the same manner as if the interlock system were not present. It may be noted that for any position of the interlock system, the pressure in the chamber 12 can be decreased to lower a load by venting the air through the line 38 to the controller by the operation of the down lever 44.

Assume that a load is present and is engaged properly by the load-engaging unit 46 and specifically the vacuum cup 54, with full vacuum established in the cup 54. The lever 80 of the load-sensing device 74 will now be raised and open the valve therein so that air from the line 62 and the line 84 will communicate through the line 86 with the inlet 98 of the load-sensitive valve 76. This air pressure will move the spool 98 toward the right and establish communication between the inlet 88 and the outlet 94 and between the lines 32 and 102. The full vacuum in the cup 54 also communicates through the end portion of the line 72 and the line 116 to the inlet 114 of the pressure-sensitive valve 78. The spring 112 is selected so that this vacuum is sufficient to overcome the force of the spring and move the spool 108 toward the right. If desired, the spring 112 can be adjustable. With the spool 108 toward the right, the inlet 106 communicates with the outlet 110 so that the line 102 communicates with the line 34. Once again then, with the load properly engaged, the line 32 communicates with the line 34 and the air supply 28 communicates with the controller 26 as if no interlock system were present. The hoist 10 can then be operated normally through the controller 26.

An object may be engaged by the vacuum cup 54 but a proper vacuum is not established either because the operator immediately tries to raise the load through the controller 26 before sufficient vacuum can be established, because the surface of the object is rough so that excess leakage occurs between it and the vacuum cup, or because the vacuum cup is defective, by way of example. In this instance, the valve of the load-sensing device 74 is open so that the inlet 88 of the valve 76 communicates with the outlet 94, whereby the lines 32 and 102 are in communication. The vacuum, in this instance, however, is insufficient to overcome the force of the spring 112 in the valve 78. Consequently, the spool 108 remains in the left hand position and the line 102 is blocked from the line 34. Hence, the lines 32 and 34 are blocked and the air supply through the line 28 cannot reach the controller 26. Consequently, any manipulation of the up lever 36 by the operator has no effect on the hoist and the improperly engaged load cannot be raised until proper vacuum is established. If the up lever 36 is held down by the operator, and the vacuum of proper value does become established between the cup 54 and the load, then the communication between the lines 32 and 34 will result and the load will begin to be raised immediately when the proper vacuum is established. Hence, the interlock system does not cause undue delay in the manipulation of the load by the operator.

It will be understood that rather than employing a vacuum, a positive pressure can be used to engage the load, as by using a clamping cylinder to clamp or squeeze the load. The pressure-sensitive valve 78 can then be designed somewhat similar to the valve 76 of FIG. 3, whereby the air pressure communicating with the end of the spool opposite the spring will overcome the force of the spring when the pressure is of a sufficient value to move the spool and cause the desired communication to be established between the inlets and outlet of the valve. A positive-pressure, load-engaging unit with which the safety system can be employed is shown in FIGS. 4 and 5 of U.S. Pat. No. 3,734,325, by way of example.

Various modifications of the above-described embodiments of the invention will be apparent to those skilled in the art, and it is to be understood that such modifications can be made without departing from the scope of the invention, if they are within the spirit and the tenor of the accompanying claims.

I claim:

1. In combination, a fluid-operated hoist including a hoist chamber, a flexible member, and a piston in said chamber for raising and lowering the flexible member in response to pressure of fluid in said chamber, fluid-operated, load-engaging means carried by said flexible member for engaging and disengaging a load, a load-sensing device having a valve with two positions, being in one position when a load is engaged by said load-engaging means and in another position when there is no load engaged by said load-engaging means, means for supplying fluid under pressure to said load-sensing device, a load-sensitive valve, means connecting said load-sensitive valve and said load-sensing device to supply fluid under pressure to said load-sensitive valve when said load-sensing device is in the one position, said load-sensing device and said load-sensitive valve enabling control of fluid under pressure in said hoist chamber when said load-sensing device is in the one position, and a remote controller for controlling the pressure of fluid in said chamber, said load-sensitive valve being in series with said remote controller and said hoist.

2. In combination, a fluid-operated hoist including a hoist chamber, a flexible member, a piston in said chamber for raising and lowering the flexible member in response to pressure of fluid in said chamber, a remote controller communicating with said hoist chamber for supplying fluid under pressure to said chamber and selectively venting pressure from said chamber, and a supply of fluid for said controller, a load-engaging unit connected with said flexible member for engaging and disengaging a load, a load-sensing device having a valve with two positions, being open when a load is engaged by said load-engaging means and being closed when there is no load engaged by said load-engaging means, means for supplying fluid under pressure to said load-sensing device, a load-sensitive valve, means connecting said load-sensitive valve with said load-sensing device to supply fluid under pressure to said load-sensitive valve when the valve of said load-sensing device is open, a pressure-sensitive valve, means connecting said load-engaging unit with said pressure-sensitive valve to cause said pressure-sensitive valve to be in one position when pressure of said load-engaging unit is of a particular value and a load is properly engaged by said unit, and said controller being in communication with said hoist to supply fluid to said chamber when said load-sensitive valve is in one position and said pressure-sensitive valve is in one position.

3. The combination according to claim 2 characterized by said pressure-sensitive valve and said load-sensitive valve being connected in series with said hoist.

4. The combination according to claim 3 characterized by said load-sensitive valve having one inlet and two outlets and said pressure-sensitive valve having two inlets and one outlet, the inlet of said load-sensitive valve and the outlet of said pressure-sensitive valve being in communication when a load is properly engaged by said load-engaging unit and when no load is present adjacent the load-engaging unit.

5. The combination according to claim 4 characterized by said load-sensitive valve inlet communicating with one of said fluid supply and said controller and said outlet of said pressure-sensitive valve communicating with the other of said fluid supply and said controller.

6. The combination according to claim 2 wherein said load-engaging unit comprises a vacuum cup for engaging and disengaging a load and said pressure-sensitive valve is in the one position when the vacuum of the vacuum cup reaches a particular value.

7. In combination, a fluid-operated hoist including a hoist chamber, a flexible member, and a piston in said chamber for raising and lowering the flexible member in response to pressure of fluid in said chamber, fluid-operated, load-engaging means carried by said flexible member for engaging and disengaging a load, a load-sensing device having a valve with two positions, being in one position when a load is engaged by said load-engaging means and in another position when there is no load engaged by said load-engaging means, means for supplying fluid under pressure to said load-sensing device, a load-sensitive valve, means connecting said load-sensitive valve and said load-sensing device to supply fluid under pressure to said load-sensitive valve when said load-sensing device is in the one position, a pressure-sensitive valve, and means connecting said pressure-sensitive valve with said fluid-operated, load-engaging means, said pressure-sensitive valve being in one position when a load is properly engaged by said load-engaging means and being in a second position otherwise, said load-sensitive valve, said load-sensing device, and said pressure-sensitive valve enabling control of fluid under pressure in said hoist when said pressure-sensitive valve is in the one position and said load-sensing device is in the one position, and also enabling control of fluid under pressure in said hoist when said pressure-sensitive valve is in the second position and said load-sensing device is in the other position.

8. The combination according to claim 7 characterized by a remote controller for controlling the pressure of fluid in said chamber, said load-sensitive valve and said pressure-sensitive valve being in series with said remote controller.

9. The combination according to claim 7 wherein said load-engaging unit comprises vacuum means for engaging and disengaging a load and said pressure-sensitive valve is in the one position when the vacuum of the vacuum means reaches a particular valve.

* * * * *